US006645133B1

(12) United States Patent
Maiwald et al.

(10) Patent No.: US 6,645,133 B1
(45) Date of Patent: Nov. 11, 2003

(54) APPARATUS FOR TRANSPORTING UNWOUND WEBS OF WRAPPING MATERIAL FOR SMOKERS' PRODUCTS

(75) Inventors: Berthold Maiwald, Schwarzenbek (DE); Torsten Mörke, Dissau (DE)

(73) Assignee: Hauni Maschinenbau AG, Hamburg (DE)

( * ) Notice: Subject to any disclaimer, the term of this patent is extended or adjusted under 35 U.S.C. 154(b) by 279 days.

(21) Appl. No.: 09/599,223

(22) Filed: Jun. 22, 2000

(30) Foreign Application Priority Data

Jun. 24, 1999 (DE) ..... 199 28 867

(51) Int. Cl.[7] ..... B31C 13/00
(52) U.S. Cl. ..... 493/4; 493/313; 493/459
(58) Field of Search ..... 493/4, 313, 459

(56) References Cited

U.S. PATENT DOCUMENTS 3,799,038 A * 3/1974 Bossons et al. ..... 162/197
3,834,145 A * 9/1974 Ellingham et al. ..... 15/306.1
3,860,944 A * 1/1975 Huber et al. ..... 118/423
3,996,842 A * 12/1976 Ehlich et al. ..... 162/255
4,158,456 A * 6/1979 Holland-Letz ..... 271/118
4,281,670 A * 8/1981 Heitmann et al. ..... 131/281
4,641,771 A * 2/1987 Masuch et al. ..... 226/115
4,830,355 A * 5/1989 Jeschke ..... 271/183
5,049,921 A * 9/1991 Sonobe et al. ..... 355/408
5,785,270 A * 7/1998 Buchko ..... 242/396.8
6,038,976 A * 3/2000 Helmstadter et al. ..... 101/174
6,220,327 B1 * 4/2001 Rothwell et al. ..... 156/256
6,325,068 B1 * 12/2001 Dombek et al. ..... 131/280

* cited by examiner

*Primary Examiner*—Rinaldi I. Rada
*Assistant Examiner*—Gloria R Weeks
(74) *Attorney, Agent, or Firm*—Venable LLP; Robert Kinberg; Chad C. Anderson

(57) ABSTRACT

A web of air-permeable uniting band material for use in a filter tipping machine is advanced lengthwise by a first pair of driven rollers and a second pair of driven rollers, first through a magazine which is located between the two pairs of rollers, thereupon around a roller-shaped flanged adjustable braking device which is located upstream of the second pair of rollers, and around an adjustable curling device between the braking device and the second pair of rollers. The braking action is regulated for the purpose of subjecting the running web to a predictable curling action. This enhances the quality of filter cigarettes wherein the tobacco-containing and the filter material-containing parts are connected to each other by adhesive-coated uniting bands constituting sections of the thus treated web.

17 Claims, 3 Drawing Sheets

APPARATUS FOR TRANSPORTING UNWOUND WEBS OF WRAPPING MATERIAL FOR SMOKERS' PRODUCTS

CROSS-REFERENCE TO RELATED CASES

This application claims the priority of commonly owned German patent application Serial No. 199 28 867.4 filed Jun. 24, 1999. The disclosure of the above-referenced German patent application, as well as that of each U.S. and foreign patent and patent application mentioned in the specification of the present application, is incorporated herein by reference.

BACKGROUND OF THE INVENTION

The invention relates to improvements in apparatus for transporting unwound webs of wrapping material, especially for smokers' products, and more particularly too improvements in apparatus for treating running webs of paper, artificial cork or other flexible sheet material. Such webs are normally drawn off bobbins and can be utilized in filter tipping machines wherein plain cigarettes, cigars or cigarillos (hereinafter referred to as cigarettes) are assembled with filter rod sections to yield filter cigarettes of unit length or multiple unit length.

It is customary to advance a web of so-called tipping paper from a bobbin or another suitable source past a perforating unit which provides the running web with pores or the like in order to render the web permeable to gaseous fluids, i.e., to permit penetration of air into the column of tobacco smoke flowing from the lighted end of a filter cigarette, through the mouthpiece and into the mouth of a smoker. It is also customary to advance successive increments of the running web past (around) a so-called curling device which promotes the tendency of the web to yield uniting bands which can be readily converted into cylindrical or oval envelopes each of which surrounds the mouthpiece and the adjacent end portion of the tobacco-containing part of a plain cigarette.

The web treating action of the curling device is greatly influenced by the nature and/or extent of treatment of the running web ahead of the curling station. The quality of filter cigarettes containing convoluted uniting bands made of a properly or optimally curled web invariably exceeds the quality of filter cigarettes containing uniting bands which are obtained as a result of repeated severing of a poorly curled web of tipping paper. The web which is being advanced toward the curling station is engaged by one or more advancing or transporting devices which not only advance but also tension those successive increments of the running web which advance past the curling station. Moreover, the bobbin which supplies the web (i.e., from which the web is being unwound) is acted upon by a brake.

A curling device can be designed to exhibit a cylindrical surface provided with suction ports which attract succesive web portions or increments trained around a portion of the cylindrical surface. The quality of curling action furnished by such device is dependent upon the nature of treatment to which the running web is subjected upstream of the curling station.

Curling devices at least some of which can be put to use in the apparatus of the present invention are disclosed, for example, in U.S. Pat. No. 3,996,842 granted Dec. 14, 1976 to Klaus-Dieter Ehlich and Heinz-Christen Lorenzen for "APPARATUS FOR REDUCING AND EQUALIZING LOCALIZED STESSES IN RUNNING PAPER WEBS OR THE LIKE".

OBJECTS OF THE INVENTION

An object of the invention is to provide a novel and improved apparatus for manipulating running strips, tapes or webs of a sheet material which is to be converted into cylindrical envelopes or the like, for example, in a tipping machine which serves to turn out filter cigarettes.

Another object of the invention is to provide a novel and improved apparatus which employs one or more so-called web curling or rolling devices.

A further object of the invention is to provide novel and improved means for treating a running web ahead or upstream of a curling device.

An additional object of the invention is to provide an apparatus which can be installed in or utilized in conjunction with existing filter tipping machines.

Still another object of the invention is to provide a novel and improved method of manipulating a running web of perforated uniting band material for use in filter tipping machines ahead of the web curling station.

A further object of the invention is to provide a novel and improved web braking and stressing device for use in the above outlined apparatus.

Another object of the invention is to provide a novel and improved combination of an adjustable web curling device and a web monitoring unit for use in the above outlined apparatus.

An additional object of the invention is to provide a novel and improved combination of at least one web curling device, adjusting means for the curling device, and means for advancing the web toward, past and beyond the curling device.

SUMMARY OF THE INVENTION

The invention is embodied in an apparatus for treating a running web of flexible sheet material, e.g., a permeable sheet material which has undergone treatment in an apparatus of the type shown in FIGS. 1 and 2 of U.S. Pat. No. 4,281,670 granted Aug. 4, 1981 to Uwe Heitmann et al. for "APPARATUS FOR INCREASING THE PERMEABILITY OF WRAPPING MATERIAL FOR ROD-SHAPED SMOKERS' PRODUCTS". The apparatus of the present invention comprises suitable means for advancing the web from a source (such as a bobbin or reel) in a predetermined direction along an elongated path; the advancing means can include a first advancing unit defining a first portion of the path and a second advancing unit defining a second portion of the path downstream of the first portion. The improved apparatus further comprises a magazine or an analogous storage facility defining a third portion of the path between the first and second portions, an adjustable suction-operated web braking device adjacent a fourth portion of the path between the third and second portions, and web curling means adjacent a fifth portion of the path between the fourth and second portions.

At least one of the first and second advancing units can comprise a pair of driven rollers which define a nip for the running web in the respective (first or second) portion of the path.

In accordance with a presently preferred embodiment, the magazine can be installed immediately downstream of the first port ion of the path and can include means for temporary storage of successive lengths of the running web in the form of one or more loops as well as means for varying the length of that portion of the running web which can be stored in the magazine.

The braking device can include means for applying to the web a variable braking force in the fourth portion of the path (i.e., upstream of the curling means), and means for adjusting the braking force. The force applying means can include a roller having a peripheral surface which contacts the web in the fourth portion of the path, and means for rotating the roller in a direction to move the peripheral surface of the roller in the fourth portion of the path counter to the (predetermined) direction of advancement of the web along its path. The arrangement can be such that the second advancing unit is set up to advance the web at a first speed whereas the means for rotating the roller of the braking device is arranged to move the peripheral surface of the roller in the fourth portion of the path at a second speed which is less than the first speed, e.g., at a second speed which is close to zero speed. The peripheral surface of the aforementioned roller of the force applying means can be provided with a plurality of suitably distributed ports, and the running web is trained over a first portion of such peripheral surface, i.e., a second portion of the peripheral surface is out of contact with the running web. The force applying means of the braking device can further include a suction generating device (e.g., a blower or fan having a suction intake) and means for connecting the suction generating device with ports which are provided in the first portion of the peripheral surface.

The just described web braking device can further comprise means for expelling impurities, if any, from the ports in the second portion of the peripheral surface of the roller forming part of the braking device. For example, the impurities expelling means can include a source of compressed gaseous fluid and means (such as axially parallel channels in the roller of the braking device) for connecting the source of compressed gaseous fluid with the ports in the second portion of the peripheral surface.

The roller of the braking device imparts to the fourth portion of the path an arcuate shape.

The apparatus can further comprise means for monitoring the tension upon the running web, particularly the tension which is generated by the second web advancing unit, and means for actuating the aforementioned adjusting means when the monitored tension is outside of a predetermined range.

The roller of the braking device can be provided with axially spaced-apart flanges flanking that portion of the web which is trained over the roller in the fourth portion of the path, namely over that portion of the roller which is provided with the aforementioned ports.

The improved apparatus can further embody that feature which is disclosed in the aforementioned '842 patent to Ehlich e al., namely means for monitoring the running web to detect the splices which connect successive elongated sections of the web to each other. The apparatus can employ an adjustable curling means, and the latter is adjusted whenever a splice advances along the fifth portion of the path. The curling means can be designed in such a way that it is adjustable between an operative and an inoperative condition, and the splice detecting monitoring means can generate signals which render the curling means inoperative during advancement of detected splices along the fifth portion of the path for the running web.

The novel features which are considered as characteristic of the invention are set forth in particular in the appended claims. The improved web treating apparatus itself, however, both as to its construction and the modes of assembling and operating the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
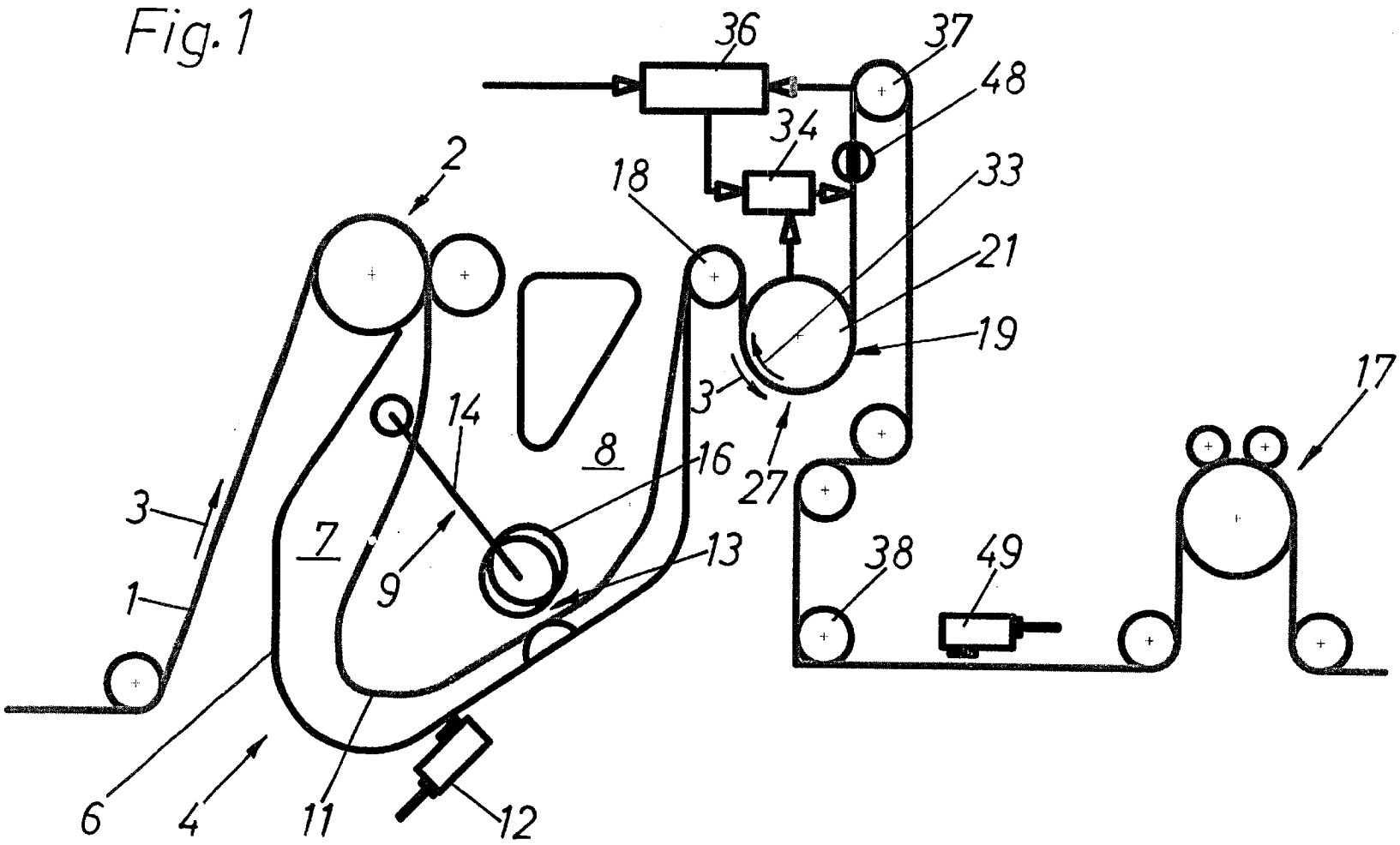
FIG. 1 is a schematic front elevational view of an apparatus which embodies one form of the present invention.
Figure 2:
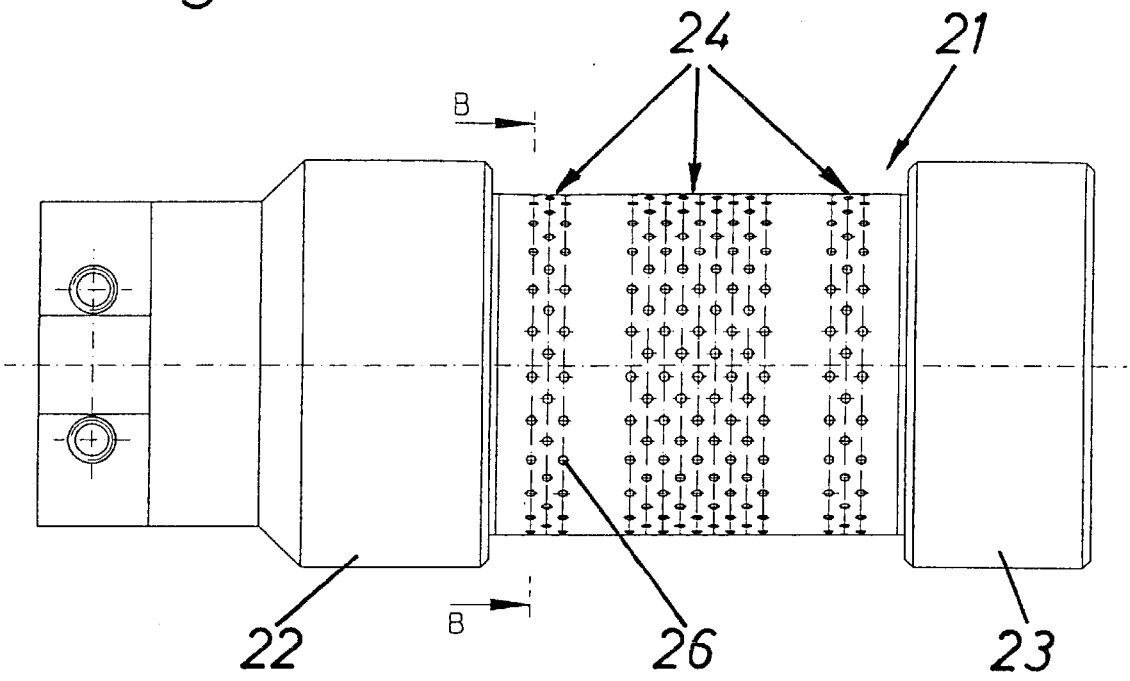
FIG. 2 is an enlarged side elevational view of a roller which forms part of the adjustable suction-operated web braking device in the apparatus of FIG. 1.

FIG. 1 shows an apparatus which serves to treat a running web consisting of so-called tipping paper and being adapted to be utilized in a filter tipping machine disclosed, for example, in FIGS. 1 and 2 of the aforementioned '670 patent to Heitmann et al. The web 1 is caused to advance lengthwise, in the direction indicated by arrows 3, by an advancing means including a first advancing unit 2 and a second advancing unit 17. The advancing unit 2 of FIG. 1 comprises two driven rollers (one of these rollers can be driven by a variable-speed prime mover (not shown) to drive the other roller by way of the web 1 which advances through the nip of the two rollers) defining a first portion or section of the elongated path for the web. The advancing unit 2 can draw the web 1 from a suitable source, such as one of the bobbins or reels shown in FIG. 1 of the '670 patent to Heitmann et al.

The porosity or permeability of the web 1 can be enhanced upstream of the first web advancing unit 2, for example, by one or more laser beams as shown in FIG. 2 of the '670 patent to Heitmann et al. The illustrated second advancing unit 17 has three rollers one of which can be driven by a motor, not shown, and the others of which can be driven by the one roller by way of the web 1 which is caused to advance through the nips of such rollers in the second portion of the path for the running web.

The apparatus of FIG. 1 further comprises a magazine 4 which defines a third portion of the path for the web 1 preferably immediately downstream of the nip of the rollers forming part of the first web advancing unit 2. The magazine 4 includes a receptacle/reservoir 6 for an elongated looped portion of the running web 1. The receptacle 6 includes an adjustable partition 9 which divides its interior into two chambers 7 and 8. The chamber 7 serves to receive a loose loop 11 (e.g., about five meters) of web material. The length of the loop 11 is monitored by a photoelectronic sensor or detector 12. The leader of the loop 11 leaves the chamber 7 and enters the chamber 8 through a relatively narrow passage or gate 13; this ensures that the web "quiets down" prior to reaching a combined braking and cleaning station accommodating an adjustable pneumatic (vacuum-operated) web braking device 19. If the length of the loop 11 drops below a preselected threshold value, the sensor 12 transmits a signal which causes a suitable motor or transmission (not shown) to pivot a lever 14 carrying initiator 16 which causes the advancing unit 2 to supply the web 1 at a higher rate in order to increase the length of the loop 11.

The second advancing unit 17 exerts upon the web 1 a pull which causes successive increments of the web to leave the chamber 8 of the receptacle/reservoir 6 by advancing over a deflecting roll 18 and thereupon along an arcuate portion for the path, namely about approximately one-half of the peripheral surface of a roller 21 forming part of the braking device 19 located in a fourth portion of the path downstream of the third portion (magazine 4) and upstream of a fifth portion defined by a curling device 38.

Figure 3:
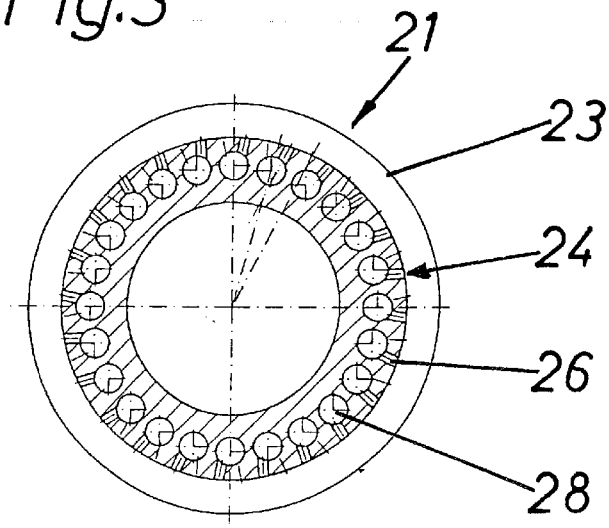
FIG. 3 is a transverse sectional view as seen in, the direction of arrows from the line B—B in FIG. 2.
Figure 4:
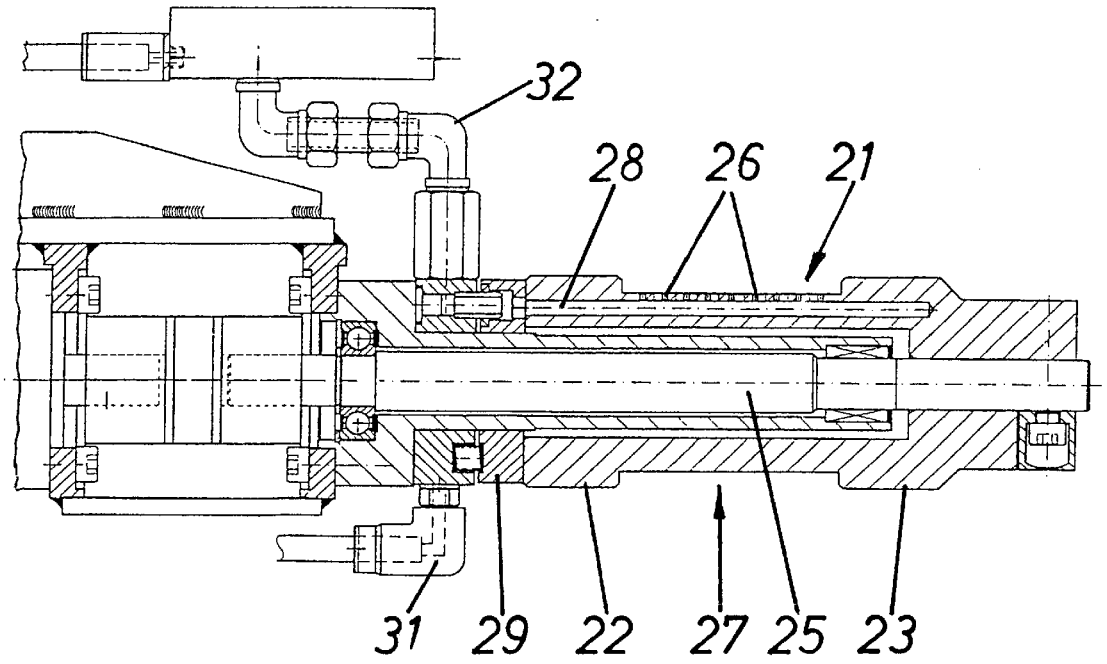
FIG. 4 is a smaller-scale axial sectional view of the roller shown in FIGS. 2–3 and a fragmentary elevational view of certain other constituents of the braking device.

As can be seen in FIGS. 2, 3 and 4, the roller 21 of the braking device 19 comprises two axially spaced-apart flanges 22, 23 which confine successive increments of the running web 1 to travel about approximately or exactly one-half of the cylindrical peripheral surface of a median portion 27 of the roller. The median portion 27 is provided with an array 24 of annuli of radially inwardly extending suction ports 26. These ports form rows which are parallel to the axis of the roller 21, and each such row communicates with one of an annular array of axially parallel channels 28 (FIGS. 3 and 4). The median portion 27 of the roller 21 surrounds a shaft 25 which serves as a means for rotating the roller 21 in the direction of arrow 33 (FIG. 1), i.e., counter to the direction (arrows 3) of advancement of the web 1 along its path from the source, through the nip of the rollers forming part of the first advancing unit 2, through the magazine 4, around the deflecting roll 18, through the braking station accommodating the median portion 27 of the roller 21 of the device 19, around the curling device 38, and through the nips of the rollers forming part of the second advancing unit 17.

Those ports 26 which are overlapped by the arcuate portion of the web 1 then advancing through the braking station are connected to a suction generating device 34 (such as an ejector type pump) by a conduit 31 and an arcuate chamber in the stationary friction ring 29 for the shaft 25 of the roller 21. The intensity of subatmospheric pressure in the conduit 31 can be regulated in several ways including by a braking force adjusting means 36 shown in FIG. 1 and being operatively connected to the suction pump 34. The braking action of the median portion 27 of the roller 21 upon the running web 1 can be regulated by varying the subatmospheric pressure in the conduit 31 and/or by varying the rotational speed of the shaft 25. The speed of this shaft can be close to zero and (as already pointed out hereinbefore) the shaft 25 rotates the roller 21 in the direction indicated by the arrow 33, i.e., counter to the direction of lengthwise movement of the web 1 (arrows 3) under the action of the advancing units 2 and 17.

Since the peripheral surface of the median portion 27 of the braking roller 21 is likely to force certain impurities (such as web fragments obtained at the perforating station ahead of the first advancing unit 2 and/or tobacco dust) into the ports 26, the device 19 preferably includes or cooperates with a port cleaning or impurities expelling device. The improved cleaning device includes a conduit 32 (FIG. 4) connected to the output of a source of compressed gaseous fluid (e.g., an air compressor, not shown) and to those ports 26 which are not overlapped by the web 1 (i.e., the ports 26 which happen to be located in the momentarily upper half of the roller 21 shown in FIG. 1). In other words, approximately one-half of the ports and the associated channels 28 receive (at any instant) compressed air via conduit 32 (and a suitable cavity in the friction ring 29) to undergo a cleaning treatment, and the other ports 26 are then connected to the suction generating device 34 by way of the conduit 31 to attract the running web 1 to the adjacent half of peripheral surface of the median portion 27 of the roller 21.

The selected low peripheral speed of the median portion 27 (in the direction indicated by the arrow 33) enables the source of compressed air to adequately clean successive groups of ports 26 before such ports are again overlapped by the web 1.

The aforementioned device 36 is preferably adjusted or set up in such a way that the braking force exerted by the ports 26 which are momentarily overlapped by the running web 1 is normally maintained at a fixed value or within a preselected optimum range. The device 36 is or can constitute a commercially available pressure regulator. For example, the suction generating device 34 can constitute a PAIB vacuum pump of the type known as M (model "Chip").

The extent or magnitude of tension in the web portion between the braking device 19 and the second web advancing unit 17 is monitored by a sensor 37 which can constitute a radial force measuring arrangement of the type known as M1191 distributed by the Firm Tensometric Messtechnik GmbH, Wuppertal, Federal Republic Germany. The sensor 37 is designed to transmit analog output signals which are utilized to regulate suction in those ports 26 of the median portion 27 of the roller 21 which are connected to the conduit 31. Such regulation compensates for those fluctuations of quality of the oncoming increments of the web 1 which are capable of influencing tension in those successive portions of the web that advance along the curling device 37.

The device 37 serves to "break" or bend the web 1 with a constant force, namely to subject the web to such treatment in the respective (fifth) portion of the path between the braking device 19 and the advancing unit 17. It has been ascertained that a web which is caused to be acted upon by a curling device while being subjected to a predetermined constant tensional stress can be subdivided into uniting bands (one shown at 43 in FIG. 5) which can be converted into superior tubular envelopes connecting plain cigarettes with filter mouthpieces, at least as far as the establishment of a desired permeability (flow of atmospheric air into the column of tobacco smoke) in the convoluted uniting bands is concerned.

Figure 5:
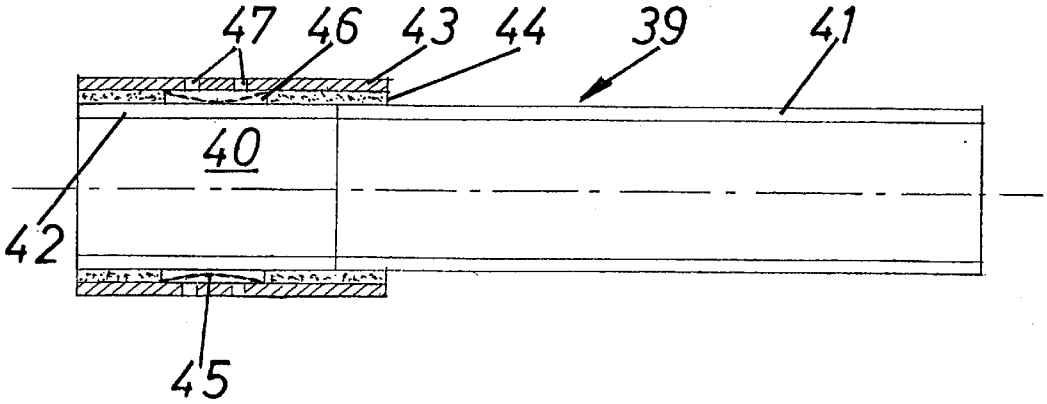
FIG. 5 is a greatly enlarged axial sectional view of a filter cigarette embodying a uniting band forming part of a web which has undergone treatment in the apparatus of the present invention.

FIG. 5 shows a finished filter cigarette 39 with all of its tubular (normally cylindrical) constituents drawn to a larger scale for the sake of clarity. Such tubular components include a cylindrical envelope 41 made of cigarette paper and surrounding a rod-shaped filler of comminuted tobacco leaves and/or reconstituted tobacco and/or artificial tobacco. The envelope 41 may but need not be porous but the tubular envelope 42 of the cylindrical filter mouthpiece 40 is made of a foraminous wrapping material. The envelope 42 and the adjacent end portion of the envelope 41 are connected to each other by a foraminous third tubular envelope 43 constituting a length of properly treated (perforated, looped, tensioned, stretched and curled) web 1. Certain perforations of the convoluted uniting band 43 are shown at 47 and are radially outwardly adjacent a non-adhesive annular portion 46 of the internal surface of the envelope 43. A layer or film 44 of a suitable adhesive (such as a hotmelt) coats the inner side of the envelope 43 at both sides of the non-adhesive annular portion 46.

If the envelope 43 is made of a convoluted uniting band constituting a section of an improperly tensioned (and hence unpredictably curled) web 1, the permeability of the composite tubular envelope including the envelope 42, the two-piece film consisting of adhesive 44, and the envelope 43 (with perforations 47 in register with the uncoated median portion of the underside of the envelope 43) will depart from optimal permeability. Improper tensioning of the web 1 can be eliminated by adjusting the braking device 19 accordingly so that the tension of successive increments of the web arriving at and being deflected by the curling device 38 is within a desired (optimum) range.

If the curling action upon successive increments of the web 1 is carried out while the tensioning of the web fluctuates, the uncoated median portion of the envelope 43 is likely to sag inwardly (as shown at 45 in FIG. 5) when the tensioning is excessive, and this alters the rate of air flow into the filter mouthpiece 40 by way of the perforations 47, the median portion of the uncoated (at 46) inner side of the envelope 43 (i.e., between the two annuli of the composite adhesive layer 44), and throug the foraminous envelope 42. The likelihood of the development of defects (at 45) is much more remote if the web 1 is subjected to the aforedescribed treatment first in the magazine 4 and thereupon in the path portion between the deflecting roll 18 and the curling station, at 38. The monitoring (at 37) and regulation (at 36) of tension (established at 19 are of particular importance for the establishment and maintenance of an acceptable curling action.

The improved apparatus can be further provided with means for monitoring the web 1 for the presence of splices (not specifically shown) which are normally utilized to connect successive lengths or strips to each other end to end to thus form a continuous web 1. The means for monitoring the web 1 for the presence of splices, is shown at 48. Signals from the monitoring means 48 are utilized to adjust, such as deactivate, the curling device 38 when a splice arrives at the curling station. The exact manner in which this can be accomplished (e.g., by resorting to a rotary or back-and-forth rockable curling device and/or to a member which lifts the spliced portion of the web off the curling device) is or can be the same as disclosed in the aforementioned '842 patent to Ehlich et al. The curling device 38 can be deactivated in its entirety (or its effect upon the condition of the web 1 can be reduced) whenever a splice reaches and advances past the curling station. For example, the sections or lengths of the web 1 between successive splices can be subjected to a first (e.g., more intensive) curling action, and the splice-containing portions of the web can be subjected to a second (e.g., less intensive) curling action. This reduces the likelihood of breakage (tearing) of the web at a splice.

FIG. 1 further shows a sensor 49 which monitors the web 1 downstream of the curling device 38 for the presence of breaks and/or cracks in the web portions advancing toward and beyond the second advancing unit 17, e.g., to an adhesive-applying station (see the composite adhesive layer 44 in FIG. 5) and thence through a cutter which repeatedly severs the leader of the web to thus produce a series of discrete uniting bands ready to be converted into envelopes 43 which are thereupon convoluted around pairs of rod-shaped articles (40+41) in a filter tipping machine serving to turn out filter cigarettes 39.

An advantage of roller cleaning means including the conduit 32 is that the suction upon that portion of the running web 1 which actually contacts the median portion 27 of the roller 21 (between the flanges 22 and 23) is less likely to depart from the selected range than in the absence of expulsion of impurities (if any) from those ports 26 which are about to be again overlapped by the web.

It is clear that other types of cleaning devices (e.g., devices which suck, rather than blow, impurities from the ports 26 momentarily not overlapped by the running web) can be utilized with equal or similar advantage. Furthermore, one can utilize a cleaning device which is set up to operate intermittently (i.e., at pre-selected intervals) rather than continuously.

The tension sensor 37 can influence the condition or operation of the preferably adjustable (such as activatable and deactivatable) curling device 38 and/or the extent to which the web is attracted to the lower half of the median portion 27 of the roller 21 shown in FIG. 1. It is presently preferred to design and set up the improved apparatus in such a way that a portion (45) of the envelope 43 does not appreciably sag (or does not sag at all) into the annular clearance between the two annuli of adhesive 44 shown in FIG. 5.

The illustrated magazine 4 can be replaced with other types of magazines which are capable of exerting a desirable (tranquilizing) influence upon successive increments of the web advancing toward the braking station.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of treating running webs of wrapping material for smokers' products and, therefore, such adaptations should and are intended to be comprehended within the meaning and range of equivalence of the appended claims.

What is claimed is:

1. Apparatus for treating a running web of flexible sheet material, comprising:

means for advancing the web from a source in a predetermined direction along an elongated path, including a first web advancing unit defining a first portion of said path and a second web advancing unit defining a second portion of said path downstream of said first portion;

a web magazine defining a third portion of said path between said first and second portions;

an adjustable suction-operated web braking device adjacent a fourth portion of said path between said third and second portions; and web curling means adjacent a fifth portion of said path between said fourth and second portions.

2. The apparatus of claim 1, wherein the web consists of air-permeable sheet material.

3. The apparatus of claim 1, wherein at least one of said advancing units comprises a pair of driven rollers defining a nip for the web in the respective portion of said path.

4. The apparatus of claim 1, wherein said magazine includes means for looping the running web in said third portion of said path.

5. The apparatus of claim 1, wherein said braking device includes means for applying to the web a variable braking force in said fourth portion of said path, and means for adjusting said braking force.

6. The apparatus of claim 5, wherein said force applying means includes a roller having a peripheral surface contacting the running web in said fourth portion of said path, and means for rotating said roller in a direction to move said peripheral surface in said fourth portion of said path counter to said predetermined direction.

7. The apparatus of claim 6, wherein said second advancing unit is arranged to advance the web at a first speed and said means for rotating comprises means for moving said peripheral surface in said fourth portion of said path at a second speed less than said first speed.

8. The apparatus of claim 6, wherein said second speed is close to zero speed.

9. The apparatus of claim 5, wherein said force applying means includes a roller having a cylindrical peripheral surface provided with a plurality of ports, the running web being trained over a first portion of said peripheral surface and said peripheral surface having a second portion out of contact with the running web, said force applying means further including a suction generating device and means for connecting the suction generating device with ports in the first portion of said peripheral surface.

10. The apparatus of claim 9, further comprising a source of compressed gaseous fluid and means for connecting the fluid source with the ports in said second portion of said peripheral surface.

11. The apparatus of claim 9, further comprising means for expelling impurities, if any, from the ports in said second portion of said peripheral surface.

12. The apparatus of claim 5, wherein said fourth portion of said path has an arcuate shape.

13. The apparatus of claim 5, wherein said second advancing unit includes means for tensioning the running web and further comprising means for monitoring the tension upon the running web.

14. The apparatus of claim 13, further comprising means for actuating said adjusting means when the monitored tension is outside of a predetermined range.

15. The apparatus of claim 5, wherein said force applying means includes a driven roller having a peripheral surface and spaced-apart annular flanges extending beyond said peripheral surface, the web being trained over said peripheral surface between said flanges in said fourth portion of said path.

16. The apparatus of claim 5 for treating a running web consisting of successive elongated sections and splices connecting successive sections of the web to each other, said curling means being adjustable and further comprising means for monitoring the web for detection of splices upstream of said fifth portion of said path and for adjusting said curling means during advancement of detected splices along said fifth portion of said path.

17. The apparatus of claim 16, wherein said curling means is adjustable between an operative and an inoperative condition and said monitoring means is arranged to render said curling means inoperative during advancement of detected splices along said fifth portion of said path.

* * * * *